US005871050A

United States Patent [19]

Dobson et al.

[11] Patent Number: 5,871,050

[45] Date of Patent: Feb. 16, 1999

[54] WELL COMPLETION METHOD

[75] Inventors: Richard M. Dobson; Jefferey D. Herndon; Leo D. Hudson, all of Bakersfield, Calif.

[73] Assignee: Bestline Liner Systems, Inc., Bakersfield, Calif.

[21] Appl. No.: 933,461

[22] Filed: Sep. 18, 1997

Related U.S. Application Data

[62] Division of Ser. No. 641,836, May 2, 1996, Pat. No. 5,735, 345.

[51] Int. Cl.[6] ..... E21B 43/04; E21B 43/08

[52] U.S. Cl. ..... 166/278; 166/51

[58] Field of Search ..... 166/51, 222, 223, 166/278

[56] References Cited

U.S. PATENT DOCUMENTS

| | | | |
|---|---|---|---|
| 3,363,694 | 1/1968 | Chancellor et al. | 166/49 |
| 3,421,586 | 1/1969 | Solum | 166/51 |
| 4,253,522 | 3/1981 | Setterberg, Jr. | 166/278 |
| 4,401,158 | 8/1983 | Spencer et al. | 166/51 |
| 4,606,408 | 8/1986 | Zunkel et al. | 166/278 |
| 4,628,993 | 12/1986 | Zunkel | 166/51 |
| 4,635,725 | 1/1987 | Burroughs | 166/278 |
| 4,726,419 | 2/1988 | Zunkel | 166/51 |
| 4,944,348 | 7/1990 | Whiteley et al. | 166/51 X |
| 5,052,483 | 10/1991 | Hudson | 166/55 |
| 5,253,708 | 10/1993 | Alexander | 166/278 |
| 5,255,741 | 10/1993 | Alexander | 166/278 |
| 5,332,038 | 7/1994 | Tapp et al. | 166/278 |
| 5,343,949 | 9/1994 | Ross et al. | 166/278 |
| 5,409,059 | 4/1995 | McHardy et al. | 166/208 |
| 5,425,423 | 6/1995 | Dobson et al. | 166/278 |
| 5,443,117 | 8/1995 | Ross | 166/278 X |
| 5,497,840 | 3/1996 | Hudson | 175/72 |
| 5,531,273 | 7/1996 | Dobson et al. | 166/278 |
| 5,535,824 | 7/1996 | Hudson | 166/207 |
| 5,613,567 | 3/1997 | Hudson | 175/72 |

FOREIGN PATENT DOCUMENTS

| | | | |
|---|---|---|---|
| 3200722 | 7/1983 | France . | |
| 1714092 | 2/1992 | U.S.S.R. | 166/51 |
| 2 221 484 | 2/1990 | United Kingdom . | |

*Primary Examiner*—David J. Bagnell
*Attorney, Agent, or Firm*—Lyon & Lyon LLP

[57] ABSTRACT

A well completion system and method including a landing adapter which can be interlocked with a landing ring. A split ring is retained within a groove in the landing adapter which operates to lock the landing adapter with the landing ring. The groove into which the shear ring is positioned has two effective diameters. A first diameter allows the shear ring to compress and pass within the landing ring. The second diameter prevents extraction without shearing of the ring. A by-pass tool is positioned with a liner assembly 14 having a landing adapter. The by-pass tool includes a valve sleeve having a first position allowing flow down the center bore into a stinger extending to a wash-in shoe. Once the liner assembly has been washed in, the valve sleeve assumes a second, open position. Gravel packing may then occur through the central bore with return through a by-pass passage through the tool. Cleaning of the liner and tool can also occur through reverse flow to the gravel packed area.

1 Claim, 7 Drawing Sheets

WELL COMPLETION METHOD

This application is a division of application Ser. No. 08/641,836, filed May 2, 1996 now U.S. Pat. No. 5,735,345.

BACKGROUND OF THE INVENTION

The field of the present invention is oil well completion tools and techniques.

Wells are conventionally drilled through production zones with casings installed to adjacent the production zones. Such casings may extend through certain production zones where multiple zones exist. In such cases, the casings may be strategically placed or later perforated to provide access to additional zones. Typically a casing does not extend to the bottom of unconsolidated sand in the production zone of the well as drilled. In sandy conditions, the bottom of the well may fill in before completion. Under many circumstances, a liner is to be placed in the well with perforations at the productive zones. Additionally, gravel packing about the liner is common.

Upon the completion of such wells, sand control adapters are frequently employed to seal the joints between the upper ends of the liners and the casings. Such devices prevent sand from being entrained into the production. One such adapter is illustrated in U.S. Pat. No. 5,052,483, the disclosure of which is incorporated herein by reference.

For well completion, it is frequently necessary to clear out the bottom of the hole, insert an appropriate liner, gravel pack the production zone or zones and seal the liner off at the casing. Multiple trips down a well are frequently required to accomplish each of these tasks. The pulling of tools is, of course, expensive. Mechanisms have been designed for accomplishing a variety of tasks with one trip down the well. U.S. Pat. No. 5,425,423, the disclosure of which is incorporated herein by reference, illustrates a well tool which can drill, under ream and gravel pack with one trip down the well. U.S. Pat. No. 5,497,840, the disclosure of which is incorporated herein by reference, discloses another completion system for drilling in, placing and hanging a liner, cementing portions of the well and providing a seal between the casing and the liner. This may be accomplished with one trip down the well. Of course all systems allow for retraction of the drill string. Some equipment may be sacrificed in the well.

The present invention is directed to well completion, minimizing trips down the well. A well may be lined, the liner locked in place, the production zone or zones gravel packed, the well cleaned and the equipment removed, all with a single trip.

Accordingly, it is an object of the present invention to provide improved well completion methods. Other and further objects and advantages will appear hereinafter.

DETAILED DESCRIPTION OF THE PREFERRED EMBODIMENT

Figure 1:
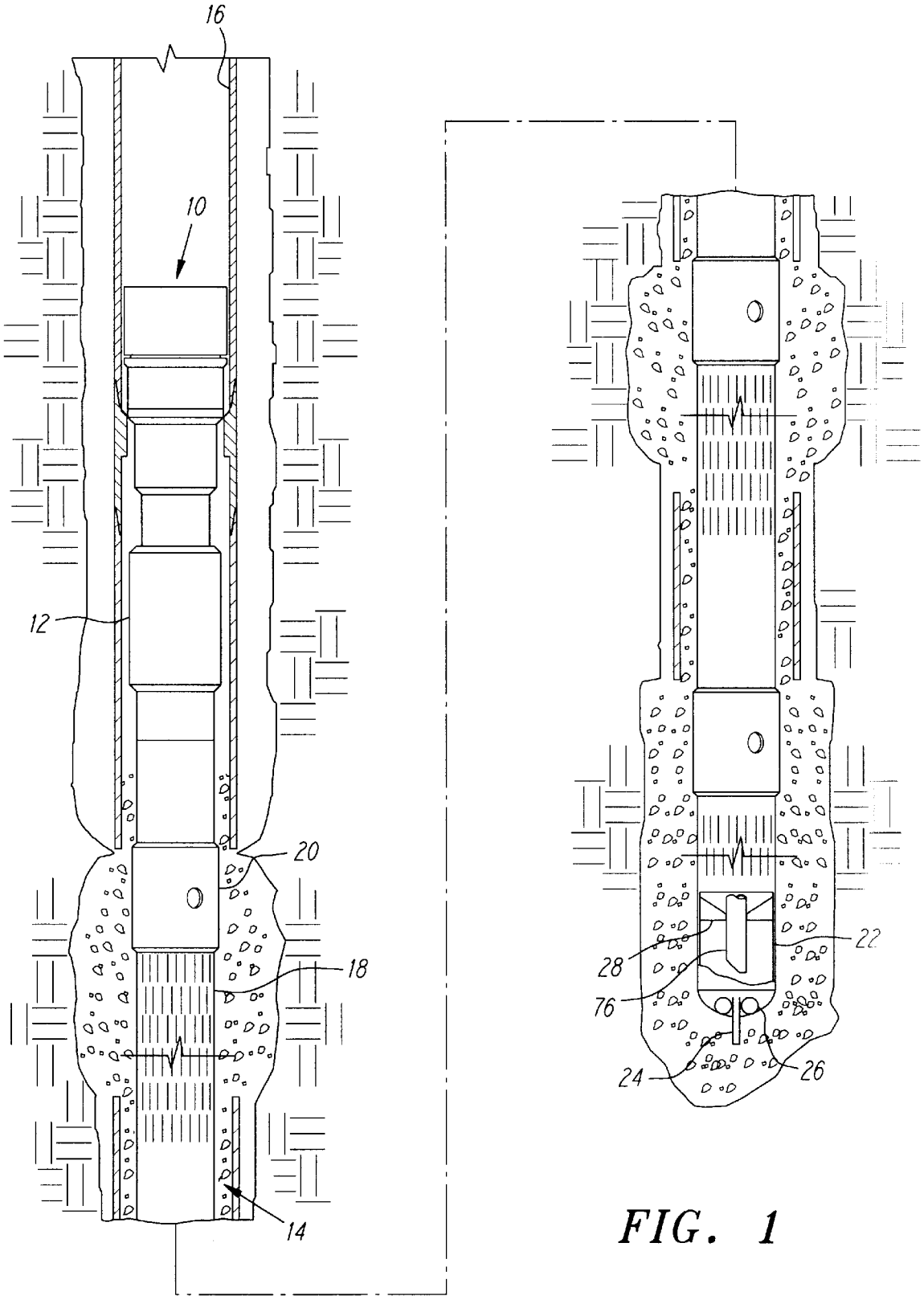
FIG. 1 is a side view of a slotted liner and landing adapter shown partially installed with the formation and casing in cross section.

Turning in detail to the drawings, FIG. 1 illustrates a landing adapter, generally designated 10, coupled with a conventional expansion joint 12 which is in turn coupled with a liner assembly, generally designated 14. The entire string is positioned with a casing 16 shown to be in multiple sections. This string may be run into a well and positioned through production zones all in one trip with a by-pass tool used to complete each zone.

The liner assembly 14 has multiple perforated sections 18 and multiple gravel pack port collars 20 most conveniently adjacent the perforated sections 18, respectively. The gravel pack port collars 20 are conventional with a rotatable sleeve within each gravel pack port collar having slots to receive dogs for rotation of the sleeve. The sleeve is rotated 90° one way to open and 90° back to close. A wash-in shoe 22 with stab-in blades 24 is attached at the end of the liner assembly 14. This shoe has ports 26 at the bottom thereof and an annular seal 28 inside of the hollow shoe 22.

Figure 2:
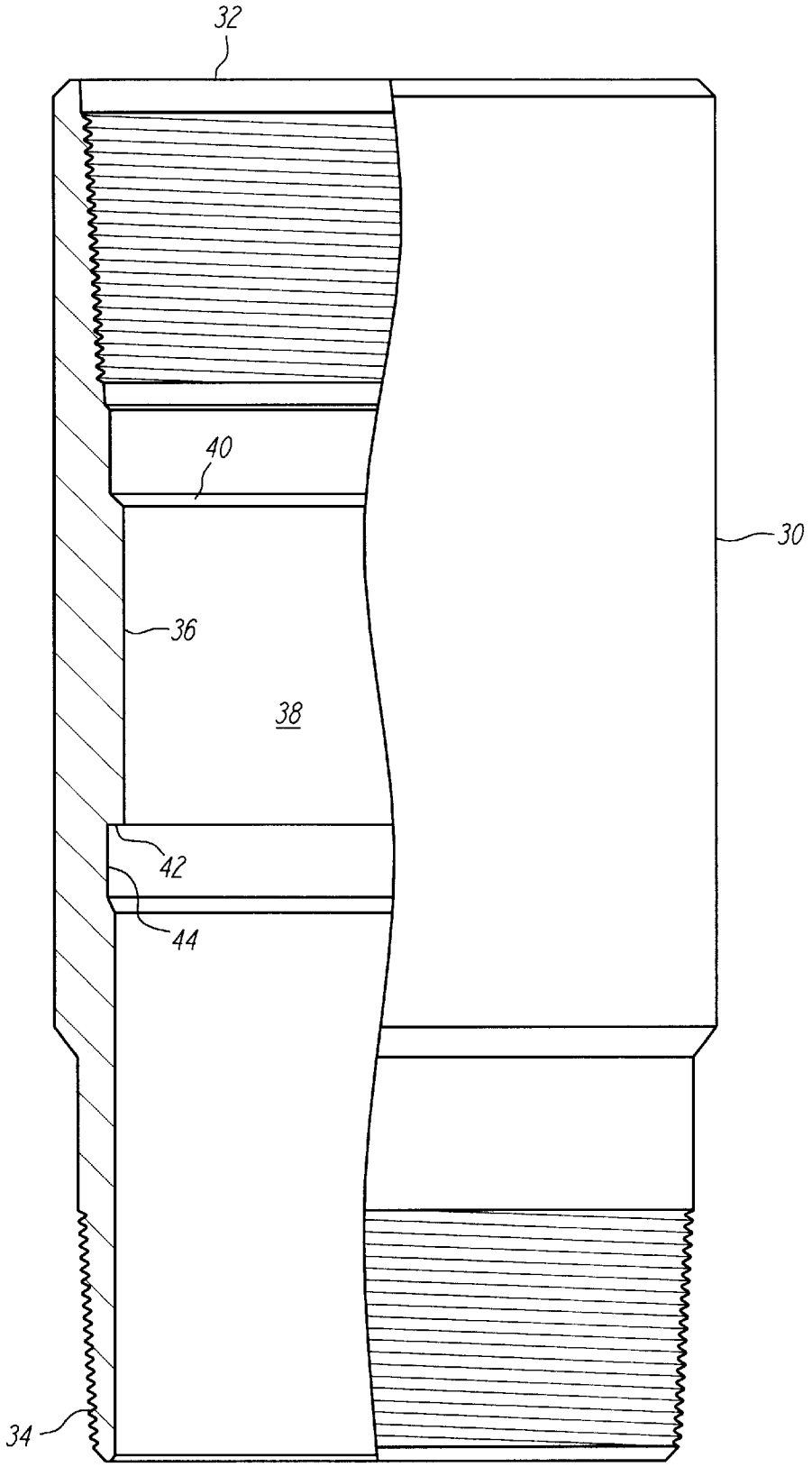
FIG. 2 is a partially cross-sectioned side view of a landing fixture.

Looking to FIG. 2, a landing fixture 30 is illustrated which may be rigidly held in place on a casing pin. The landing fixture 30 is essentially a pipe section with a threaded socket end 32 and a threaded pin end 34. The socket end 32 may be associated with the pin of a casing section to locate the fixture 30 within the well. Additional casing may be added to the threaded pin end 34.

The inside profile of the landing fixture 30 is of specific interest. A landing ring 36 extends inwardly to define a hole 38 extending axially through the fixture 30. At the upper end of the landing ring 36 is an upward landing shoulder 40 which is in the shape of a circular, truncated conical section. At the lower end of the landing ring 36 is a downward landing shoulder 42. The downward landing shoulder 42 lies within a plane normal to the axis of the landing fixture 30. A shallow inwardly facing annular channel 44 is located 10 adjacent to the downward landing shoulder 42. The lower wall of the channel 44 is shown to be tapered.

Figure 3:
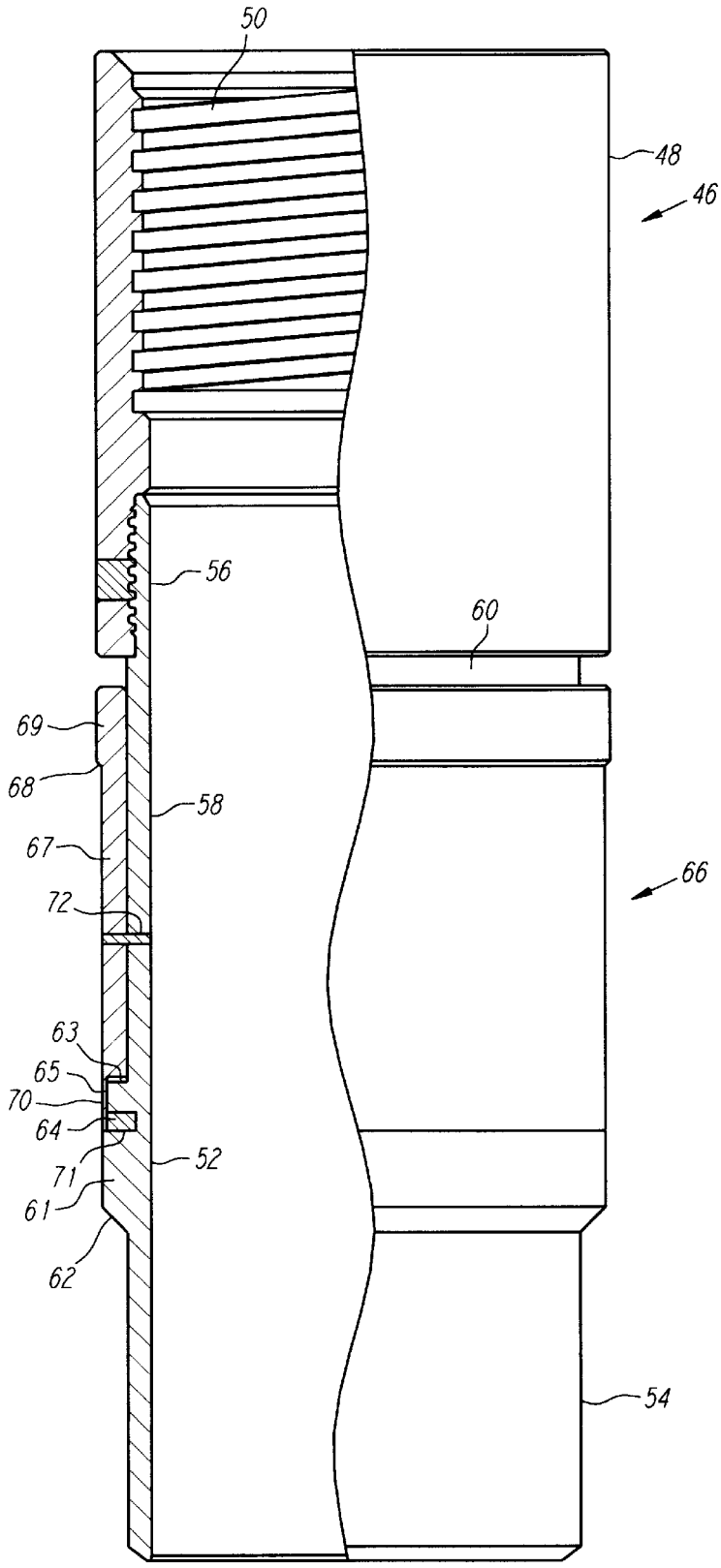
FIG. 3 is a partially cross-sectioned side view of an adapter body with an actuator and a shear ring.
Figure 4:
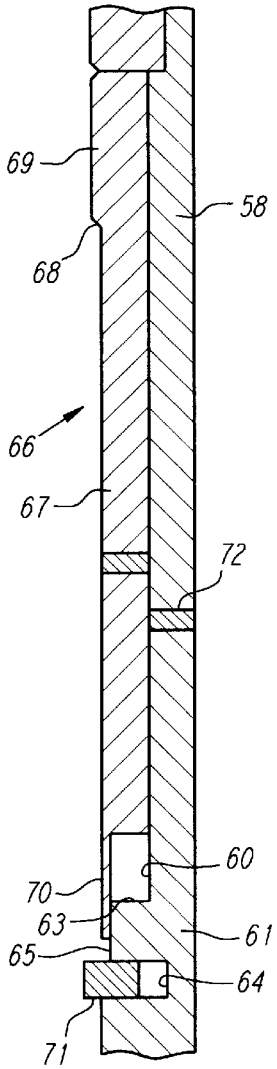
FIG. 4 is a detail of the device of FIG. 3 with the actuator in a second position.
Figure 5:
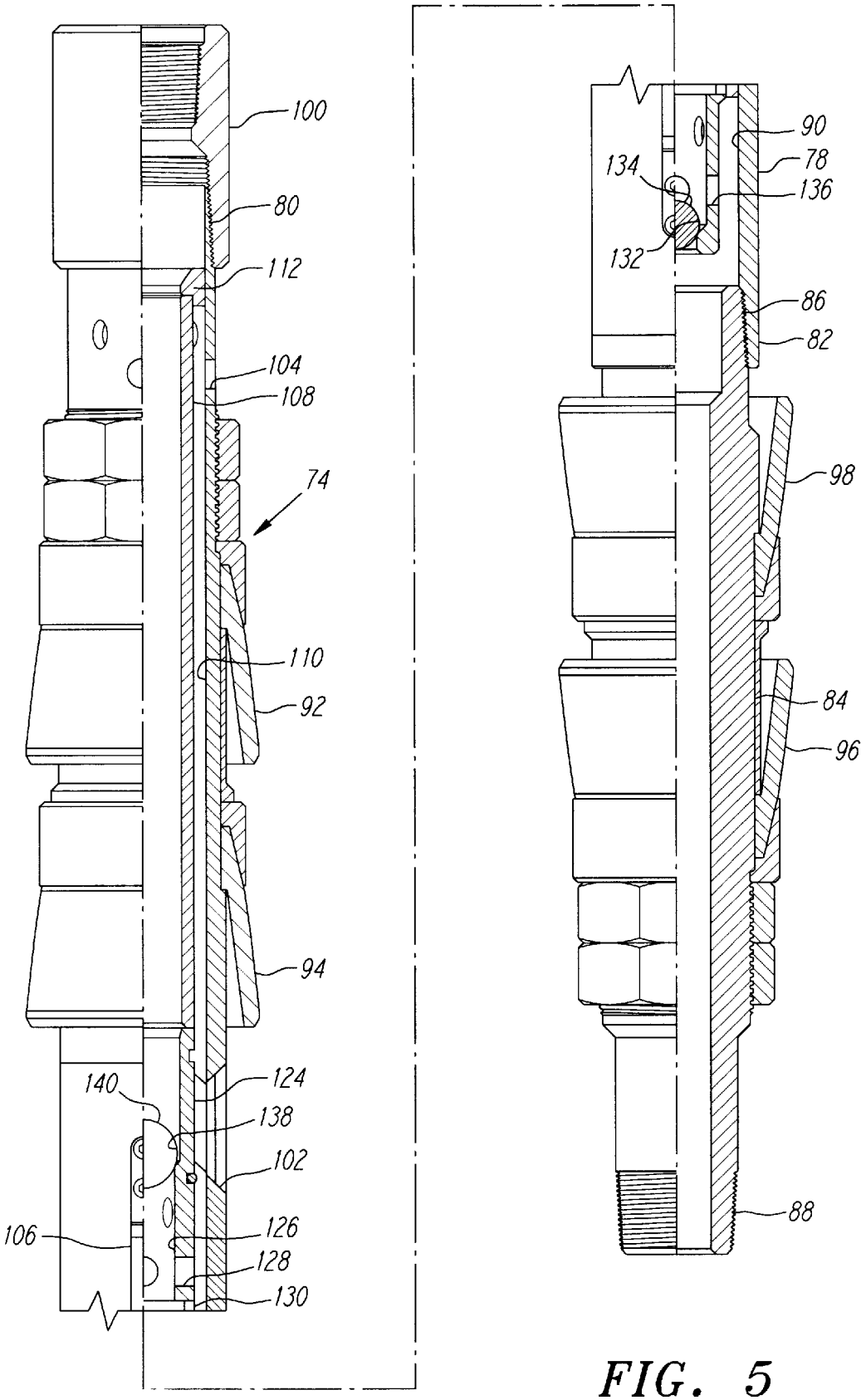
FIG. 5 is a side view partially in cross section of a by-pass tool.
Figure 6:
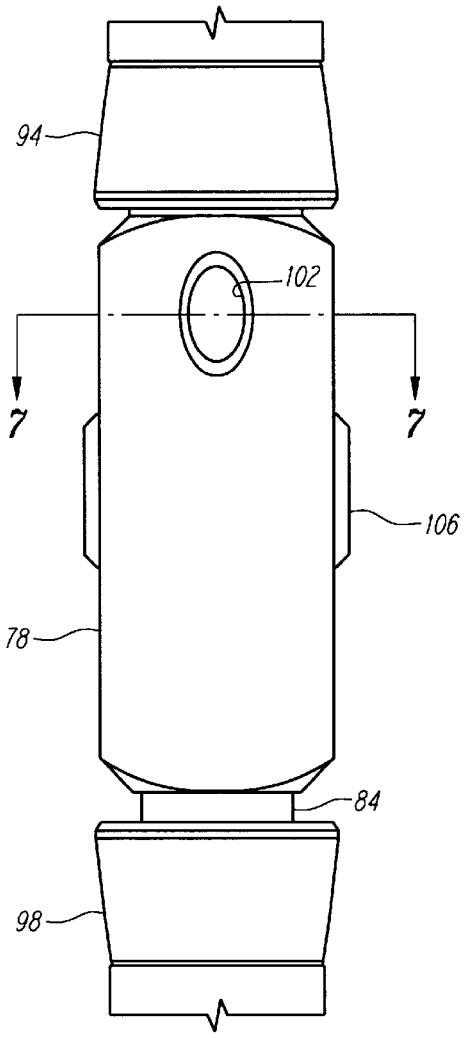
FIG. 6 is a side view of the center portion of the by-pass tool of FIG. 5 rotated 90° from that of FIG. 5.

Turning to FIG. 3, an adaptor body, generally designated 46, is constructed principally as a pipe assembly. The adaptor body 46 includes a two-thread box 48 having square threads 50 for attachment to the lower end of a drill string and the body portion 52 threaded and permanently fixed to the two-thread box 48. The body portion 52 has a pin 54 which may be configured for attachment by conventional means to a liner assembly.

The body portion 52 extends to a pin 56 which is associated with the two-thread box 48. Adjacent to that pin 56 is a thin cylindrical section 58 defining the bottom of a cavity which is an outwardly facing annular channel 60. The channel 60 is bounded on one end by the lower terminal shoulder of the two-thread box 48. At the other end, a thicker cylindrical section 61 defines the lower extent of the annular channel 60. The thicker cylindrical section 61 is beveled at the lower end 62 so as to ensure passage down the well and includes a shoulder 63 at its other end which is normal to the axis of the adaptor body 46. Between the bevel 62 and the shoulder 63, a second cavity which is an outwardly facing annular channel 64 is cut into the cylindrical section 61. Between the shoulder 63 and the annular channel 64, an outwardly facing annular recess 65 provides relief in the outer surface.

An actuator sleeve, generally designated 66, is positioned within the outwardly facing annular channel 60. The sleeve 66 is positionable on the thinner cylindrical section 61 prior to assembly of the two-thread box 48 with the body portion 52. The sleeve 66 has an annular body 67 which specifically fits on the thinner cylindrical section 61 to slide along the surface thereof. The body 67 is shorter in axial length than the annular channel 60 in order that it might take either of two extreme positions, either against the shoulder 63 or against the terminal shoulder of the two-thread box 48.

The actuator sleeve 66 further includes an engagement shoulder 68. The engagement shoulder 68 is shown to be a circular, truncated conical shoulder defined by a thicker cylindrical portion 69 at one end of the actuator sleeve 66.

At the other end of the actuator sleeve 66, an extension in the form of annular skirt 70 extends from one end of the annular body 67. The skirt 70 is sized to extend over the outwardly facing annular recess 65 and is of sufficient length to further extend over the annular channel 64 when the actuator sleeve 66 is positioned against the shoulder 63.

A shear ring 71 is located within the annular channel 64. This shear ring 71 may be of brass, metal or even plastic, depending upon its dimensions and the amount of force at which it is to be sheared. In the current embodiment, the shear strength of the ring may be on the order of 80,000–100,000 pounds. The shear ring 71 is also split and arranged in a relaxed state to have a gap in order that the ring may be compressed. The dimensions of the shear ring 71 are such that a first position is achieved with the shear ring 71 extending outwardly of the annular channel 64 in the relaxed state. In a compressed state, the shear ring 71 assumes a second position which has an outside diameter allowing the ring 71 to be placed within the skirt 70.

Before entry into a well, the adaptor is arranged with the actuator sleeve in the extreme lower position. In this position, the shear ring 71 is compressed and arranged beneath the skirt 70. Shear pins 72 are arranged about the adaptor and extend between the adaptor body and the actuator sleeve. The skirt 70 further fits within the outwardly facing annular recess 65 so that the entire adaptor below the engagement shoulder 68 fits within the hole 38 in the landing ring 36.

In the second extreme position, the annular body 67 is against the lower terminal shoulder of the two-thread box 48. The shear pins 72 are sheared and the skirt 70 has fully disengaged the shear ring 71 so that it may obtain its relaxed state. The axial difference between the annular channel 60 and the annular body 67 is such that the annular skirt 70 is fully displaced from the shear ring 71. The engagement shoulder 68 with the annular body in the upper extreme position is to be distanced from the near side of the shear ring 71 such that the landing ring 36 fits within that space.

In operation, the adaptor is placed down the well with the landing fixture 30 already in place and attached to the well casing. The adaptor body 46 is arranged with the actuator sleeve 66 with the shear pins 72 unbroken and the skirt 70 extending over the shear ring 71. Once the adaptor meets the landing ring 36, the engagement shoulder 68 engages the upward landing shoulder 40. This shears the pins 72 and causes the sleeve 66 to move to its second extreme position. At this time, the actuator sleeve is seated. The shear ring 71 is released so as to extend into the shallow channel 44 below the downward landing shoulder 42. In this way, the landing ring 36 is captured between the engagement shoulder 68 and the shear ring 71. Once positioned, extraction requires a shearing of the shear ring 71. By requiring a shear strength of 80,000–100,000 pounds, the shear ring 71 is only likely to be sheared under intentional upward force applied through the drill string.

Delivered to the well with the liner assembly 14 and landing adapter 10 is a by-pass tool, generally designated 74. Associated with the lower end of the by-pass tool 74 is a stinger 76 (FIG. 1). The stinger fits within and is sealed by the annular seal 28 within the wash-in shoe 22. The stinger is thus in communication with the ports 26.

Figure 7:
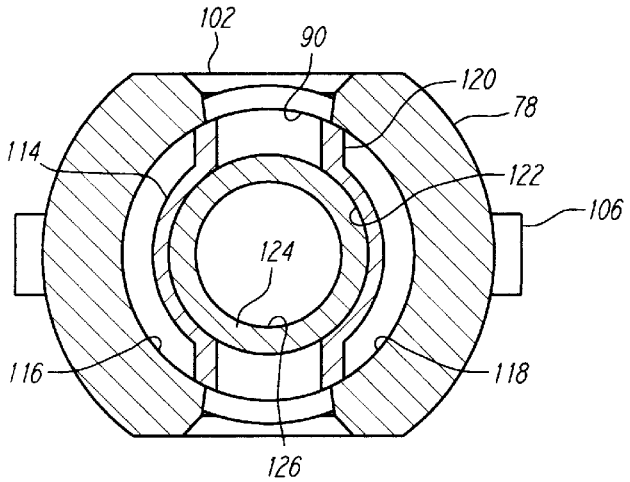
FIG. 7 is a cross-sectional view taken along line 7—7 of FIG. 6.

The by-pass tool 74 includes a main barrel 78. The barrel 78 is substantially cylindrical except for the lower portion which includes a cross section as seen in FIG. 7. A pin 80 is at one end and an interiorly threaded socket 82 is at the other. A barrel extension 84 includes a pin 86 associated with the socket 82. The barrel extension 84 is also generally cylindrical and extends to a pin 88 to which may be attached the stinger 76. A central bore 90 extends through the barrel 78 and the barrel extension 84. Gravel pack cups 92 and 94 are conventionally arranged and accommodated on the exterior of the barrel 78. Similarly gravel pack cups 96 and 98 are associated with the exterior of the barrel extension 84. The cups, 92, 94, 96 and 98 are arranged to either side of a gravel packing section of the barrel 78. A collar 100 is associated with the pin 80 of the barrel 78 for attachment to the drill string.

Diametrically opposed gravel ports 102 extend radially through the barrel 78 at a position between the upwardly sealing pack cups 92 and 94 and the downwardly sealing gravel pack cups 96 and 98. These ports 102 are sized and arranged such that they may be aligned with the ports located in the gravel pack port collars 20 when indexed axially in the bore. Also extending radially through the barrel 76 are upper ports 104 located above the gravel pack cup 92 for communication with the annular space between the liner assembly 14 and the barrel 78. The barrel also includes spring loaded radially outwardly biased dogs 106 which are conventionally employed with the gravel pack port collars 20. With the dogs 106 engaged with a specific port collar 20, the gravel ports 102 are then aligned with the gravel pack port collar 20. Rotation of the string 90° then causes the port collar 20 to open. Rotation in the opposite direction then closes the port collar 20.

Turning to inwardly of the barrel 78, an annular sleeve 108 is positioned concentrically within and displaced inwardly from the barrel 78. The sleeve extends through a first length of the barrel defining a substantially annular side passage 110. At the upper end, a ring 112 closes the side passage 110. This ring 112 is above the upper ports 104 such that the annular side passage 110 is in communication with those upper ports 104. At the lower end of the annular sleeve 108, an annular seat 114 is defined which defines the annular space forming the annular side passage 110 below the annular sleeve 108. The annular seat 114, however, divides the annular side passage 110 into two by-pass passages 116 and 118 extending lengthwise through a portion of the bore of the barrel 78. The annular seat 114 thus defines a portion of the gravel ports 102 by outwardly extending walls 120 as can best be seen in FIG. 7 which form oblong passages from the center of the annular seat to the gravel ports 102. In this way, the annular seat 114 defines by-pass passages 116 and 118 which communicate with the annular side passage 110 to extend communication downwardly around the gravel ports 102 in a manner such that the by-pass passages 116 and 118 are not in communication with the gravel ports 102 extending through both the annular seat 114 and the wall of the barrel 78.

The annular seat 114 has a central bore 122 as can best be seen in FIG. 7. A valve sleeve 124 is positioned within the central bore 122 of the annular seat 114. The valve sleeve 124 itself includes a bore 126 in part defining the central bore 90.

The valve sleeve 124 includes return ports 128 extending radially through the sidewall. Below the return ports, a retainer 130 extends across the bore 126. A one-way valve including a valve seat 132 and a valve ball 134 are provided within the bore 126 of the valve sleeve 124. The retainer 130 keeps the valve ball 134 near the valve seat 132. The one-way valve controls flow through the bore 126. Above the valve ball 134 when positioned on the valve seat 132 are wash-in ports 136.

Figure 8:
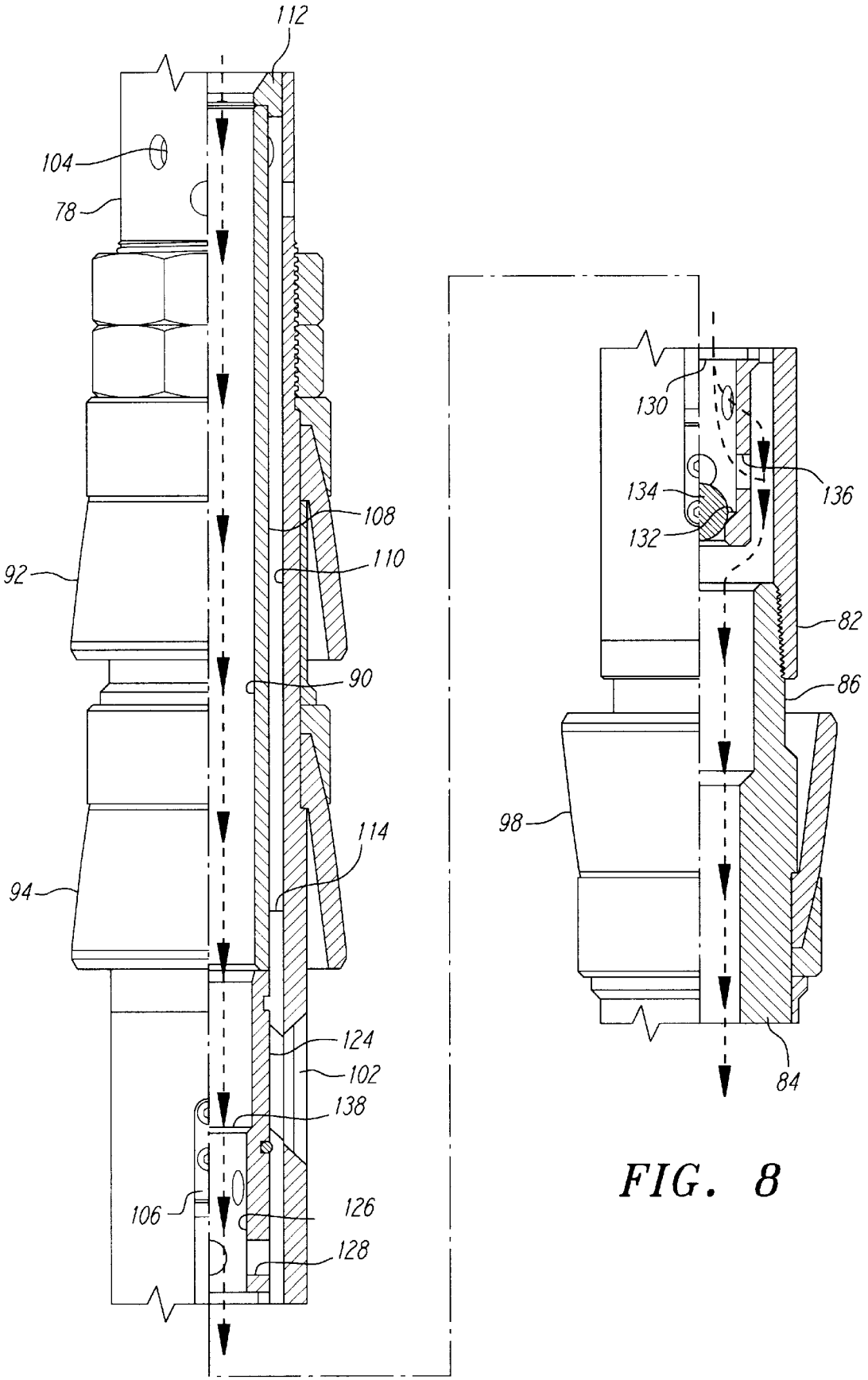
FIG. 8 is a side view of the by-pass tool in partial cross section with the tool configured for flow fully therethrough.
Figure 9:
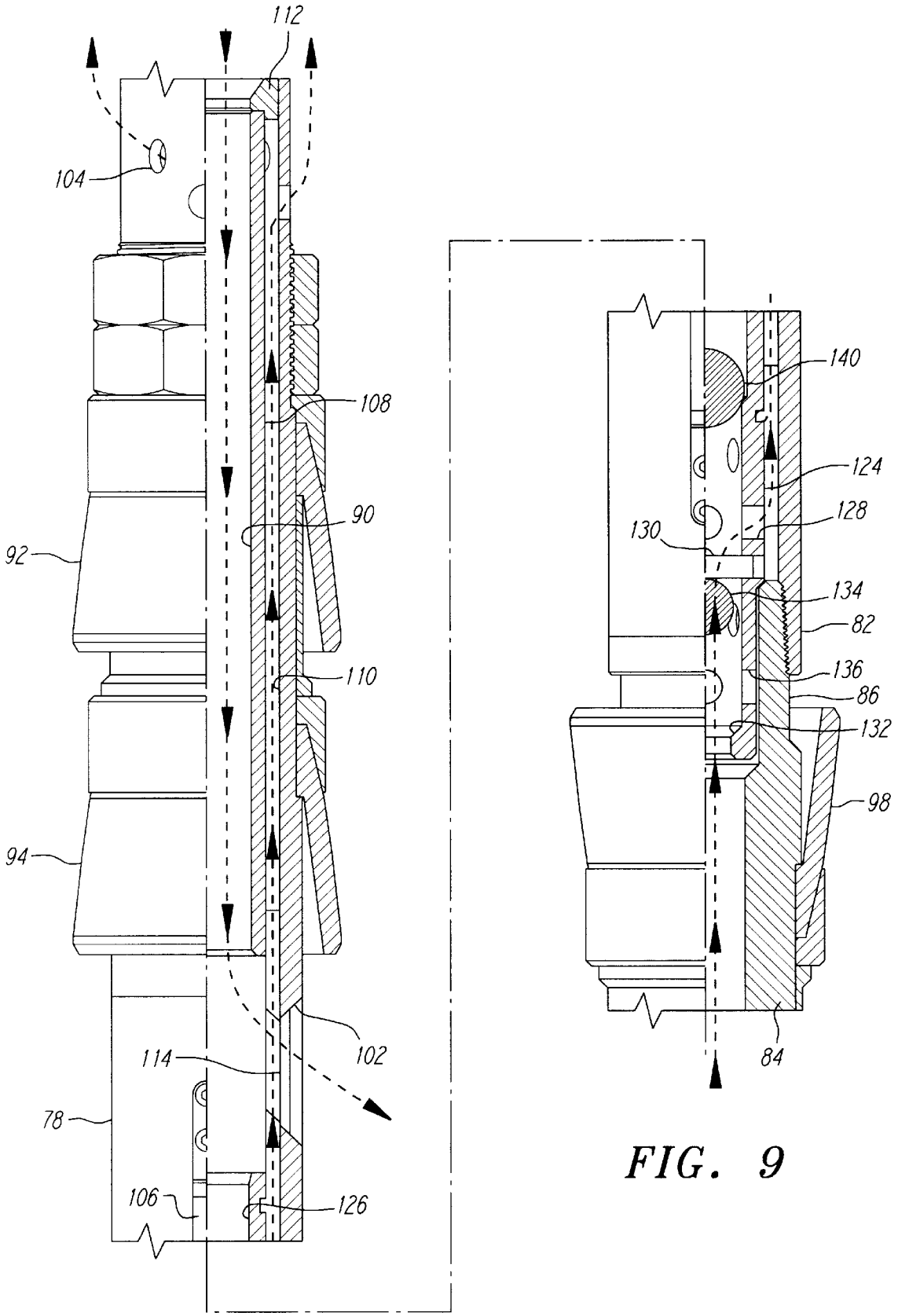
FIG. 9 is a side view of the by-pass tool in partial cross section with the tool configured for gravel pack flow.

The valve sleeve 124 moves from a first, closed position as illustrated in FIG. 8 to an open position as illustrated in FIG. 9. Shear pins retain the valve sleeve 124 in the closed position through initial operations. In the closed position, the valve sleeve 124 extends over the gravel ports 102. The return ports 128 are also positioned on the valve sleeve 124 such that they are closed with the valve sleeve 124 in the closed position. The valve sleeve 124 extends downwardly below the annular seat 114 such that the wash-in ports 136 are open with the valve sleeve 124 in the closed position. Also in the closed position, the lower end of the valve sleeve 124 is displaced from the pin 86 of the barrel extension 84 so that communication may flow from the central bore 90 through the central bore 122, out the wash-in ports 136, around the lower end of the closed valve sleeve 124 and again down through the central bore 90 in the barrel extension 84.

The valve sleeve 124 has a second valve seat 138 above the one-way valve. The placement of a valve ball 140 on the valve seat 138 causes pressure to increase in drilling fluid above the ball valve 140. The shear pins fail and the valve sleeve 124 moves to the open position as seen in FIG. 9. In the open position, the valve sleeve 124 is displaced from the gravel ports 102 such that they are in communication with the central bore 90. The return ports 128 also pass downwardly below the bottom of the annular seat 114 and are open to communicate with the by-pass passages 116 and 118. The lower portion of the valve sleeve 124 seats into the pin 86 of the barrel extension 84. Thus, any communication along the central bore 90 across the one-way valve is controlled by the valve ball 134.

In operation, the by-pass tool is assembled with the liner assembly 14 before lowering into the well. The stinger 76 extends through the annular seal 28 to be in communication with the ports 26 of the wash-in shoe 22. The valve sleeve 124 is in the closed position. The condition of the by-pass tool is as seen in FIG. 8 at this time. The well was first drilled, a casing positioned and portions under reamed. Consequently, accumulation of debris is expected to have accumulated at the bottom of the well.

As the combination of the liner assembly 14 and the by-pass tool is lowered to encounter the debris, the fluid is pumped down the drill pipe and through the central bore 90. When the fluid encounters the one-way valve at the bottom of the valve sleeve 124, it is able to flow through the wash-in ports 136, around the bottom end of the valve sleeve 124 and back to the central bore 90 as it extends through the barrel extension 84. The flow continues to the stinger 76 and out through the ports 26 of the wash-in shoe 22. Because of the annular seal 28, the drilling fluid exits through the ports 28 to outwardly of the liner assembly 14. The fluid along with entrained debris flows upwardly in the annular space between the liner assembly 14 and either the well bore or the casing 16. This flow washes out debris and allows the liner assembly 14 to be washed into position at the bottom of the well.

When appropriately positioned, the landing adapter 10 associated with the liner assembly 14 approaches and captures the landing ring 30. The flow of fluid and debris had been proceeding about the landing adapter and up the annulus within the casing 16. However, when the landing adapter 10 seats on the landing ring 30, this circulation is interrupted. The ball valve 140 is then placed in the drill pipe bore where it is conveyed to the valve seat 138. The pressure of the fluid behind the seated valve ball 140 shears the pins associated with the valve sleeve 124 and the valve sleeve 124 assumes the second, open position.

Once the valve ball 140 is in place and the valve sleeve 124 opened, flow can proceed through the pipe bore downwardly through the central bore 90 and out the gravel ports 102. The lowermost zone may then be gravel packed in a conventional manner.

The fluid return during gravel packing may be through the perforated liner sections 18 and up through the stinger 76. The valve ball 134 of the one-way valve allows flow upwardly into the valve sleeve 124. Return fluid may then pass through the return ports 128 to the by-pass passages 116 and 118 and the annular side passage 110. The returning flow then exits through the upper ports 104 to the annulus within the casing 16 to return to surface.

Once the gravel pack has been complete in an under reamed zone, it may be advantageous to clear the liner between the gravel pack cups 94 and 96 and the central bore 90 as well as the drill string. Flow of the drilling fluid can be reversed, delivered down the annulus of the well, past the cups 92 and 94 to the gravel ports 102. The fluid can then return through the central bore 90.

Once this operation has been completed, the by-pass tool can be lifted upwardly to the next gravel pack port collar 20 and the tool positioning, gravel packing and cleaning may be repeated. This process can be repeated for each zone. Once this is accomplished, the tool may be pulled from the well. Manipulation of by-pass tools have tended to lift the liner assembly 14 out of position. Use of the landing adapter 10 prevents such unwanted extraction of the liner assembly 14. With the removal of the by-pass tool, the well is complete.

Accordingly, improved completion equipment and methods have been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A method of completing a well having a casing therein, comprising the consecutively performed steps of positioning a liner and a by-pass tool in the well;

washing in the liner with flow through the by-pass tool;

locking the liner to the casing;

closing flow through the by-pass tool;

opening gravel ports through the by-pass tool;

gravel packing through the by-pass tool;

reversing flow through the liner to the by-pass tool to flush sand from the tool; and extracting the by-pass tool from the well.

* * * * *